US010858747B2

(12) United States Patent
Kaczmarek et al.

(10) Patent No.: US 10,858,747 B2
(45) Date of Patent: Dec. 8, 2020

(54) ACIDIC ZINC AND ZINC NICKEL ALLOY PLATING BATH COMPOSITION AND ELECTROPLATING METHOD

(71) Applicant: Atotech Deutschland GmbH, Berlin (DE)

(72) Inventors: Michal Kaczmarek, Trebur (DE); Antje Richter, Mainz (DE); Lukas Bedrnik, Trebur-Astheim (DE); Eric Sibürge, Trebur-Astheim (DE)

(73) Assignee: Atotech Deutschland GmbH, Berlin (DE)

( * ) Notice: Subject to any disclaimer, the term of this patent is extended or adjusted under 35 U.S.C. 154(b) by 0 days.

(21) Appl. No.: 15/503,735

(22) PCT Filed: Oct. 19, 2015

(86) PCT No.: PCT/EP2015/074150
§ 371 (c)(1),
(2) Date: Feb. 14, 2017

(87) PCT Pub. No.: WO2016/066467
PCT Pub. Date: May 6, 2016

(65) Prior Publication Data

US 2017/0275774 A1 Sep. 28, 2017

(30) Foreign Application Priority Data

Oct. 27, 2014 (EP) ..... 14190510

(51) Int. Cl.
*C25D 3/56* (2006.01)
*C25D 3/22* (2006.01)

(52) U.S. Cl.
CPC ..... *C25D 3/22* (2013.01); *C25D 3/565* (2013.01)

(58) Field of Classification Search
CPC ..... C25D 3/22; C25D 3/565; C25D 3/562
USPC ..... 205/246, 313, 314, 260
See application file for complete search history.

(56) References Cited

U.S. PATENT DOCUMENTS

| | | | | |
|---|---|---|---|---|
| 4,285,802 | A * | 8/1981 | Rynne | C25D 3/565 205/246 |
| 4,416,737 | A | 11/1983 | Austin et al. | |
| 5,200,057 | A | 4/1993 | Canaris | |
| 5,656,148 | A | 8/1997 | Martyak et al. | |
| 6,143,160 | A | 11/2000 | Diaddario, Jr. | |
| 7,442,286 | B2 | 10/2008 | Capper et al. | |
| 2003/0085130 | A1 | 5/2003 | Verberne et al. | |
| 2005/0133376 | A1 | 6/2005 | Opaskar et al. | |
| 2005/0189231 | A1 * | 9/2005 | Capper | C25D 3/565 205/246 |
| 2015/0221295 | A1 | 8/2015 | Feldhaus et al. | |

FOREIGN PATENT DOCUMENTS

| | | | | |
|---|---|---|---|---|
| AT | 199449 | | 9/1958 | |
| CN | 101942684 | | 1/2011 | |
| EP | 1489201 | | 12/2004 | |
| EP | 1489201 | A2 * | 12/2004 | C07C 309/10 |
| FR | 2723595 | A3 * | 2/1996 | C25D 3/22 |
| FR | 2723595 | A3 | 2/1996 | |
| KR | 19990049604 | A * | 7/1999 | C25D 3/56 |
| KR | 20020051276 | A | 6/2002 | |
| KR | 1020020051276 | A * | 6/2002 | C07C 309/10 |
| KR | 1020020051276 | A * | 6/2002 | C25D 3/00 |

OTHER PUBLICATIONS

Search Report for corresponding Chinese Application No. 201580047800.1 dated Jan. 11, 2018 and its partial English translation.
PCT/EP2015/074150; PCT International Search Report and Written Opinion of the International Searching Authority dated Jan. 27, 2016.
PCT/EP2015/074150; PCT International Preliminary Report on Patentability dated Jan. 19, 2017.
Office Action for Brazilian Patent Application No. BR112017003631-2 dated Jan. 7, 2020.
English Translation of Office Action for Korean Patent Application No. 10-2017-7007557 dated Jul. 1, 2019.

* cited by examiner

*Primary Examiner* — Edna Wong
(74) *Attorney, Agent, or Firm* — Renner, Otto, Boisselle & Sklar, LLP

(57) ABSTRACT

The present invention relates to an acidic zinc or zinc-nickel alloy plating bath composition comprising a source for zinc ions, optionally a source for nickel ions, a source for chloride ions and at least one dithiocarbamyl alkyl sulfonic acid or salt thereof. Said plating bath composition and the corresponding plating method result in zinc or zinc-nickel alloy layers having an improved throwing power and thickness distribution, particularly when plating substrates having a complex shape and/or in rack-and-barrel plating.

12 Claims, No Drawings

ACIDIC ZINC AND ZINC NICKEL ALLOY PLATING BATH COMPOSITION AND ELECTROPLATING METHOD

The present application is a U.S. National Stage Application based on and claiming benefit and priority under 35 U.S.C. § 371 of International Application No. PCT/EP2015/074150, filed 19 Oct. 2015, which in turn claims benefit of and priority to European Application No. 14190510.9 filed 27 Oct. 2014, the entirety of both of which is hereby incorporated herein by reference.

FIELD OF THE INVENTION

The present invention relates to plating bath compositions and electroplating methods for the deposition of zinc and zinc-nickel alloys onto a substrate.

BACKGROUND OF THE INVENTION

Zinc and zinc alloy plating are standard methods to increase resistance to corrosion of metallic substrates such as cast iron and steel substrates. The most common zinc alloys are zinc-nickel alloys. The plating bath compositions used for said purpose are generally divided in acidic and alkaline (cyanide and non-cyanide) plating bath compositions.

Plating methods using acidic zinc and zinc-nickel alloy plating bath compositions show several advantages over alkaline plating bath compositions such as a higher current efficiency, higher brightness of the deposit, plating speed and less hydrogen embrittlement of the plated substrate (Modern Electroplating, M. Schlesinger, M. Paunovic, $4^{th}$ Edition, John Wiley & Sons, 2000, page 431).

A disadvantage of zinc and zinc-nickel alloy plating methods using acidic plating bath compositions over alkaline plating bath compositions is the decreased throwing power. Accordingly, the thickness of the zinc or zinc-nickel alloy deposit shows a higher dependency of the local current density. The thickness of the deposit (and likewise the resistance to corrosion) is lower in substrate regions where the local current density is lower and higher in substrate regions where the local current density is higher. The inferior throwing power of acidic zinc and zinc-nickel alloy plating methods is particularly a concern when plating substrates having a complex shape such as brake calipers and/or when using rack-and-barrel plating.

U.S. patent application US 2003/0085130 A1 discloses a zinc-nickel electrolyte and method for depositing zinc-nickel alloys wherein the usable current density range is increased by addition of an aromatic or aliphatic carboxylic acid or derivative thereof.

The U.S. Pat. No. 6,143,160 A discloses a method for improving the macro throwing power for acidic, chloride-based zinc electroplating baths. To achieve this effect, an additive in the form of an aromatic hydrocarbon, including carboxyl groups in an ortho position is used. Preferably the additive includes also electron withdrawing groups, such as halides, sulfonic acid, trifluoromethyl, cyano and amino groups.

European patent application EP 0545089 A2 discloses an additive composition for acid zinc or zinc alloy plating baths which comprises a mixture of poly-(N-vinyl-2-pyrrolidone) and at least one sulfur containing compound which enables deposition of bright and ductile zinc and zinc alloy layers at low current densities.

OBJECTIVE OF THE PRESENT INVENTION

It is the objective of the present invention to provide an acidic plating bath composition and an electroplating method using said acidic plating bath compositions having an improved plating behaviour at low local current densities and accordingly, an improved thickness uniformity of the deposit, particularly when plating substrates having a complex shape and/or in rack-and-barrel plating applications.

SUMMARY OF THE INVENTION

This objective is solved by an acidic zinc or zinc-nickel alloy plating bath composition comprising a source for zinc ions, a source for chloride ions and having a pH value in the range of 2 to 6.5, characterized in that it further comprises at least one dithiocarbamyl alkyl sulfonic acid or salt thereof.

The acidic zinc or zinc-nickel alloy plating bath composition according to the present invention is free from polyalkyleneglycols such as polyethyleneglycol and other alloying metals than zinc and nickel.

The acidic zinc-nickel alloy plating bath composition further comprises a source for nickel ions for depositing a zinc-nickel alloy.

The concentration of the at least one dithiocarbamyl alkyl sulfonic acid or salt thereof of the acidic zinc-nickel alloy plating bath composition ranges from 0.5 to 100 mg/l.

The concentration of zinc ions of the acidic zinc-nickel alloy plating bath composition ranges from 5 to 100 g/l.

This objective is further solved by an electroplating method for depositing zinc or a zinc alloy onto a substrate using said acidic zinc or zinc-nickel alloy plating bath composition.

The zinc or zinc-nickel alloy deposits have an improved plating behaviour at low local current densities in terms of thickness uniformity and substrate coverage due to the improved throwing power and covering power of the acidic zinc or zinc-nickel alloy plating bath composition according to the present invention.

DETAILED DESCRIPTION OF THE INVENTION

The acidic zinc or zinc-nickel alloy plating bath composition according to the present invention comprises a source for zinc ions, a source for chloride ions and in addition a source for nickel ions in case of an acidic zinc-nickel alloy plating bath.

Said acidic zinc or zinc-nickel alloy plating bath composition is preferably an aqueous composition.

The pH value of the acidic zinc or zinc-nickel alloy plating bath composition according to the present invention ranges from 2 to 6.5, preferably from 3 to 6 and more preferably from 4 to 6.

The acidic zinc or zinc-nickel alloy plating bath composition according to the present invention is free from polyalkyleneglycols such as polyethyleneglycol.

The acidic zinc or zinc-nickel alloy plating bath composition according to the present invention is free from other alloying elements than zinc and nickel.

Suitable sources for zinc ions comprise ZnO, $Zn(OH)_2$, $ZnCl_2$, $ZnSO_4$, $ZnCO_3$, $Zn(SO_3NH_2)_2$, zinc acetate, zinc methane sulfonate and mixtures of the aforementioned. The concentration of zinc ions ranges from 5 to 100 g/l, preferably from 10 to 100 g/l and more preferably from 10 to 50 g/l.

Suitable sources for optional nickel ions comprise $NiCl_2$, $NiSO_4$, $NiSO_4.6H_2O$, $NiCO_3$, $Ni(SO_3NH_2)_2$, nickel acetate, nickel methane sulfonate and mixtures of the aforementioned. The concentration of optional nickel ions ranges from 5 to 100 g/l, preferably from 7.5 to 80 g/l and more preferably from 10 to 40 g/l.

The acidic zinc or zinc-nickel alloy plating bath according to the present invention further comprises a source for chloride ions ("chloride baths").

The concentration of chloride ions in case $ZnCl_2$ is the source for zinc ions is not high enough. Accordingly, further chloride ions need to be added to the acidic zinc and zinc-nickel alloy plating bath compositions.

Suitable sources for chloride ions comprise salts of hydrochloric acid such as sodium chloride, potassium chloride, ammonium chloride and mixtures of the aforementioned. The overall concentration of chloride ions in the acidic plating bath composition ranges from 70 to 250 g/l, preferably from 100 to 200 g/l.

The acidic zinc or zinc-nickel alloy plating bath composition according to the present invention is preferably free from ammonia.

The acidic zinc or zinc-nickel alloy plating bath composition according to the present invention further comprises a complexing agent for nickel ions if nickel ions are present in said plating bath composition. Said complexing agent is preferably selected from aliphatic amines, poly-(alkylenimines), non-aromatic poly-carboxylic acids, non-aromatic hydroxyl carboxylic acids and mixtures of the aforementioned.

The source of nickel ions and the complexing agent is preferably added to the plating bath composition as such.

In one embodiment of the present invention, the source for nickel ions is mixed with the complexing agent for nickel ions in water prior to addition to the plating bath composition. Accordingly, a nickel complex compound/salt is added as the source of nickel ions to the plating bath composition.

Suitable aliphatic amines comprise 1,2-alkylenimines, monoethanolamine, diethanolamine, triethanolamine, ethylendiamine, diethylentriamine, triethylenetetramine, tetraethylenepentamine, pentaethylenehexamine and the like.

Suitable poly-(alkylenimines) are for example Lugalvan® G-15, Lugalvan® G-20 and Lugalvan® G-35, all available from BASF SE.

Suitable non-aromatic poly-carboxylic acids and non-aromatic hydroxyl carboxylic acids preferably comprise compounds capable to form chelate complexes with zinc ions and/or nickel ions such as citric acid, tartaric acid, gluconic acid, alpha-hydroxybutyric acid etc. and salts thereof like the corresponding sodium, potassium and/or ammonium salts.

The concentration of the at least one complexing agent for nickel ions preferably ranges from 0.1 to 150 g/l, more preferably from 1 to 50 g/l.

The acidic zinc or zinc-nickel alloy plating bath composition according to the present invention further comprises at least one dithiocarbamyl alkyl sulfonic acid or salt thereof represented by formula (I):

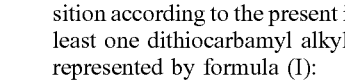

$$(R^1R^2)N—C(S)S—R^3—SO_3R^4 \quad (I)$$

wherein $R^1$ and $R^2$ are independently selected from the group consisting of hydrogen, methyl, ethyl, 1-propyl, 2-propyl, 1-butyl, 2-butyl, and tert-butyl, $R^3$ is selected from the group consisting of methylene, ethylene, propylene, butylene, pentylene and hexylene and $R^4$ is selected from the group consisting of hydrogen, and a cation.

Preferably, $R^1$ and $R^2$ are equal and selected from the group consisting of hydrogen, methyl, ethyl, 1-propyl, 2-propyl, 1-butyl, 2-butyl, and tert-butyl, $R^3$ is selected from the group consisting of ethylene, propylene and butylene, and $R^4$ is selected from the group consisting of hydrogen, sodium, potassium and ammonium ions.

The concentration of the at least one dithiocarbamyl alkyl sulfonic acid or salt thereof ranges from 0.5 to 100 mg/l and preferably from 1 to 50 mg/l.

The technical effect of the at least one dithiocarbamyl alkyl sulfonic acid or salt thereof in the acidic plating bath composition according to the present invention is an improved throwing power of said acidic plating bath composition when depositing a zinc or zinc-nickel alloy layer onto a substrate. Accordingly, the thickness distribution of the deposited layer is more uniform when comparing the thickness in low local current density and high local current density areas of the substrate to be plated.

The acidic plating bath composition according to the present invention preferably further comprises at least one anionic surfactant such as sulfonated compounds such as sulfonated benzene, sulfonated naphthalene, and mixtures of the aforementioned. The concentration of said surfactant ranges from 0.1 to 30 g/l, preferably from 0.5 to 10 g/l. Such surfactants improve the wetting behaviour of the substrate to be plated without negatively influencing the plating itself.

The acidic zinc or zinc-nickel alloy plating bath composition optionally further comprises an additive improving the appearance of the deposited zinc or zinc-nickel alloy, said additive selected from substituted propargyl compounds. This additive improves the gloss of the deposited zinc or zinc-nickel alloy deposit. Suitable substituted propargyl compounds comprise propargyl alcohol alkoxylates such as propargyl alcohol propoxylate, propargyl alcohol ethoxylate, 2-butyne-1,4-diol propoxylate, propargyl compounds having an amine group such as N,N-diethyl-2-propyne-1-amine and propargyl compounds comprising a sulfoalkylether group such as propargyl-(3-sulfopropyl)-ether and mixtures of the aforementioned. Such additives are for example commercially available under the trade names Golpanol® and Raluplate®.

The concentration of said optional additive ranges from 0.05 to 10 ml/l, preferably from 0.2 to 4 ml/l.

The acidic zinc or zinc-nickel alloy plating bath composition according to the present invention preferably further comprises an aromatic carboxylic acid, salt, ester or amide thereof. Preferably, "aromatic" means carbon-aromatic. The aromatic carboxylic acid, salt, ester or amide thereof can comprise one, two or three carboxylate residues.

Suitable salts of the aforementioned aromatic carboxylic acids are for example sodium, potassium and ammonium salts. Suitable esters of the aforementioned aromatic carboxylic acids are for example methyl esters, ethyl esters and propyl esters.

Suitable aromatic carboxylic acid or salts thereof selected from the group consisting of benzoic acid, phthalic acid, 1,3,5-benzene tricarboxylic acid, 1-naphtalene carboxylic acid, 1,3-naphthalene dicarboxylic acid, naphthalene tricarboxylic acid, regioisomeric derivatives of the aforementioned, sodium, potassium and ammonium salts and methyl, ethyl and propyl esters of the aforementioned.

The concentration of the aromatic carboxylic acid, salt, ester or amide thereof preferably ranges from 0.1 to 20 g/l, more preferably from 0.5 to 10 g/l.

The technical effect of said aromatic carboxylic acid, salt, ester or amide thereof is an improved covering power of the plating bath composition. Accordingly, zinc and zinc nickel alloy plating from the plating bath composition according to the present invention is feasible in regions of a substrate having a very low local current density, e.g. inner portions of a slim tube. Hence, plating of zinc or a zinc-nickel alloy is feasible in those areas of a substrate having a very low local current density.

The acidic zinc and zinc-nickel alloy plating bath composition according to the present invention most preferably comprises at least one dithiocarbamyl alkyl sulfonic acid or salt thereof according to formula (I) and an aromatic carboxylic acid, salt, ester or amide thereof.

The synergistic technical effect of the combination of at least one dithiocarbamyl alkyl sulfonic acid or salt thereof according to formula (I) and an aromatic carboxylic acid, salt, ester or amide thereof is an improvement of the plating behaviour in the low local current density region of a substrate. The thickness of zinc or a zinc-nickel alloy in such low local current density areas of a substrate is increased in respect to high local current density areas of the same substrate. Accordingly a more uniform thickness distribution of the deposited zinc or zinc-nickel alloy layer over the entire plated surface of a substrate is obtained when using the acidic zinc or zinc-nickel alloy plating bath composition according to the present invention in the presence of at least one dithiocarbamyl alkyl sulfonic acid or salt thereof according to formula (I) and an aromatic carboxylic acid, salt, ester or amide thereof.

The acidic zinc or zinc-nickel alloy plating bath composition according to the present invention optionally further comprises at least one acid in case the desired pH value range and ionic strength is not achieved by the other ingredients of said plating bath composition, such an acidic zinc ion source like $ZnCl_2$.

The optional acid is selected from the group comprising hydrochloric acid, sulfuric acid, nitric acid, phosphoric acid, alkyl and aryl sulfonic acids, mixtures of the aforementioned and any other acid suitable to obtain the desired plating bath pH Value range.

The acidic plating bath composition according to the present invention optionally further comprises a buffer additive such as acetic acid, a mixture of acetic acid and a corresponding salt, boric acid and the like in order to maintain the desired pH value range during operation of said plating bath composition.

The acidic zinc or zinc-nickel alloy plating bath comprising zinc ions and optionally nickel ions, a source for chloride ions, at least one dithiocarbamyl alkyl sulfonic acid or salt thereof and having a pH value in the range of 2 to 6.5, which is free of polyalkyleneglycols and other alloying metals than zinc and nickel ions can be used for plating zinc and zinc-nickel alloy layers having an improved thickness uniformity.

The electroplating method for depositing zinc or a zinc alloy onto a substrate according to the present invention comprises, in this order, the steps of (i) providing a substrate having a metallic surface as a cathode, (ii) contacting said substrate with an acidic zinc or zinc-nickel plating bath composition comprising zinc ions, optionally nickel ions and a source for chloride ions and having a pH value in the range of 2 to 6.5, characterized in that it further comprises at least one dithiocarbamyl alkyl sulfonic acid or salt thereof and which is free of polyalkyleneglycols and other alloying metals than zinc and nickel ions, (iii) applying an electrical current between said substrate and at least one anode and thereby depositing a zinc or zinc-nickel alloy layer with an improved thickness uniformity onto said substrate.

Suitable anode materials are for example zinc, nickel and mixed anodes comprising zinc and nickel.

The plating bath is preferably held at a temperature in the range of 20 to 50° C. The acidic zinc and zinc-nickel alloy plating bath composition according the present invention can be employed in all types of industrial zinc and zinc-nickel alloy plating processes such as rack plating, barrel plating and high speed plating of metal strips and wires.

The current density ranges applied to the substrate (cathode) and at least one anode depends from the plating process: for example a current density in the range of 0.3 to 5 $A/dm^2$ is preferably applied for rack plating and barrel plating.

The technical effect of an improved throwing power is most preferably used for plating of substrates having a complex shape and/or in rack plating and barrel plating. Typical substrates having a complex shape comprise brake calipers, holders, clamps and tubes.

The phrase "complex shape" in respect to substrates to be plated by the method according to the present invention is defined herein as a shape which generates different local current density values on the surface during electroplating. In contrast, a substrate having e.g. an essentially flat, plate-like shape such as a metal strip is not considered a substrate having a complex shape.

EXAMPLES

The following non-limiting examples further illustrate the present invention.

General Procedure

The plating experiments were conducted in a Hull-cell in order to simulate a wide range of local current densities on the substrate ("Hull-cell panel") during electroplating. The substrate material was steel and the size was 100 mm×75 mm.

The desired technical effect of an improved throwing power was determined by thickness measurements of the deposited zinc and zinc-nickel alloy layers by X-ray fluorescence measurements using a Fischerscope X-Ray XDL-B device from Helmut Fischer GmbH. Thickness reading were made at high local current density (HCD) and at low local current density (LCD) areas of the Hull cell panels. Where the HCD area was specified as an area 2.5 cm from the left border of the Hull cell panels and the LCD as an area 2.5 cm from the right border of the Hull cell panels. The LCD and HCD regions of an one-ampere panel correspond to a local current density of 0.5-0.6 and 3-3.5 $A/dm^2$, respectively. At each LCD and HCD region of the Hull cell panels five individual thickness measurements were done and then averaged.

The throwing power of the plating bath compositions tested was determined from the ratio of the HCD/LCD thickness values measured, and the effect of the at least one dithiocarbamyl alkyl sulfonic acid or salt thereof was determined by comparing the HCD/LCD ratios of panels prepared using an acidic zinc plating bath composition and an acidic zinc-nickel alloy plating bath composition each with and without the at least one dithiocarbamyl alkyl sulfonic acid or salt thereof.

Example 1 (Comparative)

The throwing power of an acidic zinc plating bath composition comprising 53 g/l $ZnCl_2$, 176 g/l KCl and 0.4 g/l sodium benzoate which was free of a dithiocarbamyl alkyl sulfonic acid or salt thereof was tested.

The thickness of the obtained zinc layer in the HCD area of the Hull panel was 15.7 μm, the thickness in the LCD area was 2.6 μm and the resulting thickness ratio HCD area:LCD area was 6.

Example 2 (Invention)

The throwing power of an acidic zinc plating bath composition comprising 53 g/l $ZnCl_2$ and 176 g/l KCl which further comprised 6 mg/l of a salt of a dithiocarbamyl alkyl sulfonic acid with $R^1$ and $R^2$=ethyl, $R^3$=propylene and $R^4=Na^+$ and 0.4 g/l sodium benzoate was tested.

The thickness of the obtained zinc layer in the HCD area of the Hull panel was 12.2 μm, the thickness in the LCD area was 4 μm and the resulting thickness ratio HCD area:LCD area was 3.

Accordingly, the throwing power of the plating bath matrix used in Example 1 is improved in the presence of a salt of a dithiocarbamyl alkyl sulfonic acid with $R^1$ and $R^2$=ethyl, $R^3$=propylene and $R^4=Na^+$.

Example 3 (Comparative)

The throwing power of an acidic zinc-nickel alloy plating bath composition comprising 40 g/l $ZnCl_2$, 100 g/l $NiCl_2 \cdot 6H_2O$, 0.6 g/l of an aliphatic amine as complexing agent for nickel ions, 200 g/l KCl and 0.4 g/l sodium benzoate which was free of a dithiocarbamyl alkyl sulfonic acid or salt thereof was tested.

The thickness of the obtained zinc-nickel alloy layer in the HCD area of the Hull panel was 11 μm, the thickness in the LCD area was 2.7 μm and the resulting thickness ratio HCD area:LCD area was 4.

Example 4 (Invention)

The throwing power of an acidic zinc-nickel alloy plating bath composition used in Example 3 was modified with 6 mg/l of a salt of a dithiocarbamyl alkyl sulfonic acid with $R^1$ and $R^2$=ethyl, $R^3$=propylene and $R^4=Na^+$ and 1.5 g/l sodium-benzoate was tested.

The thickness of the obtained zinc-nickel alloy layer in the HCD area of the Hull panel was 10.3 μm, the thickness in the LCD area was 3.5 μm and the resulting thickness ratio HCD area:LCD area was 2.9.

Accordingly, the throwing power of the plating bath matrix used in Example 3 is improved in the presence of a salt of a dithiocarbamyl alkyl sulfonic acid with $R^1$ and $R^2$=ethyl, $R^3$=propylene and $R^4=Na^+$.

The invention claimed is:

1. An acidic zinc-nickel alloy plating bath composition comprising a source for zinc ions, a source for nickel ions, a source for chloride ions and having a pH value in the range of 2 to 6.5, characterized in that the composition further comprises at least one dithiocarbamyl alkyl sulfonic acid or salt thereof represented by formula (I)

$$(R^1R^2)N—C(S)SR^3—SO_3R^4 \quad (I)$$

wherein $R^1$ and $R^2$ are independently selected from the group consisting of hydrogen, methyl, ethyl, 1-propyl, 2-propyl, 1-butyl, 2-butyl, and tert-butyl, $R^3$ is selected from the group consisting of methylene, ethylene, propylene, butylene, pentylene and hexylene and $R^4$ is selected from the group consisting of hydrogen and a cation, and the composition is free of polyalkyleneglycols and other alloying metals than zinc and nickel ions, wherein the concentration of the at least one dithiocarbamyl alkyl sulfonic acid or salt thereof ranges from 0.5 to 100 mg/l; and wherein the concentration of zinc ions ranges from 5 to 100 g/l, and wherein the concentration of chloride ions ranges from 70 to 200 g/l.

2. The acidic zinc-nickel alloy plating bath composition according to claim 1 wherein the concentration of the at least one dithiocarbamyl alkyl sulfonic acid or salt thereof ranges from 1 to 50 mg/l.

3. The acidic zinc-nickel alloy plating bath composition according to claim 1 wherein said acidic zinc-nickel alloy plating bath composition further comprises at least one aromatic carboxylic acid, salt, ester or amide thereof.

4. The acidic zinc-nickel alloy plating bath composition according to claim 3 wherein the at least one aromatic carboxylic acid, salt, ester or amide thereof is selected from the group consisting of benzoic acid, phthalic acid, 1,3,5-benzene tricarboxylic acid, 1-naphtalene carboxylic acid, 1,3-naphtalene dicarboxylic acid, naphthalene tricarboxylic acid, regioisomeric derivatives thereof, sodium, potassium and ammonium salts and methyl, ethyl and propyl esters of the aforementioned.

5. The acidic zinc-nickel alloy plating bath composition according to claim 4 wherein the concentration of the at least one aromatic carboxylic acid, salt, ester or amide thereof ranges from 0.1 to 20 g/l.

6. The acidic zinc-nickel alloy plating bath composition according to claim 1 wherein the concentration of zinc ions ranges from 10 to 100 g/l.

7. The acidic zinc-nickel alloy plating bath composition according to claim 1 wherein the concentration of chloride ions ranges from 100 to 200 g/l.

8. The acidic zinc-nickel alloy plating bath composition according to claim 1 wherein the concentration of nickel ions ranges from 5 to 100 g/l.

9. The acidic zinc-nickel alloy plating bath composition according to claim 1 further comprising a complexing agent for nickel ions selected from the group consisting of aliphatic amines, poly-(alkylenimines), non-aromatic poly-carboxylic acids, non-aromatic hydroxyl carboxylic acids and mixtures of the aforementioned.

10. The acidic zinc-nickel alloy plating bath composition according to claim 9 wherein the concentration of the complexing agent for nickel ions ranges from 0.1 to 150 g/l.

11. The acidic zinc-nickel alloy plating bath composition according to claim 1 wherein the concentration of the at least one dithiocarbamyl alkyl sulfonic acid or salt thereof ranges from 0.5 to 50 mg/l.

12. A method for zinc-nickel alloy electroplating comprising, in this order, the steps of:

(i) providing a substrate having a metallic surface as a cathode, (ii) contacting said substrate with the acidic zinc-nickel alloy plating bath composition according to claim 1, and (iii) applying an electrical current between said substrate and at least one anode and thereby depositing a zinc-nickel alloy layer with an improved thickness uniformity onto said substrate.

* * * * *